US005522960A

United States Patent [19]

Rello et al.

[11] Patent Number: 5,522,960

[45] Date of Patent: Jun. 4, 1996

[54] METHOD AND APPARATUS FOR APPLYING LABELS TO TAPERED ARTICLES

[75] Inventors: Robert M. Rello, Slatington; Michael Yager, Shaver; Ramon A. Martinez, Wilkes-Barre, all of Pa.

[73] Assignee: CMS Gilbreth Packaging Systems, Trevose, Pa.

[21] Appl. No.: 411,455

[22] Filed: Mar. 28, 1995

Related U.S. Application Data

[62] Division of Ser. No. 342,780, Nov. 21, 1994.

[51] Int. Cl.[6] ..... B65C 9/00

[52] U.S. Cl. ..... 156/215; 156/448; 156/458; 156/456; 156/568

[58] Field of Search ..... 156/187, 215, 156/446, 447, 448, 449, 456, 566, 567, DIG. 31, 568, 458

[56] References Cited

U.S. PATENT DOCUMENTS

| | | | |
|---|---|---|---|
| 2,703,660 | 3/1955 | von Hofe et al. | 156/566 X |
| 3,235,433 | 2/1966 | Cvacho et al. . | |
| 3,565,724 | 2/1971 | Yamaguchui et al. . | |
| 3,577,293 | 5/1971 | Ritterhoff . | |
| 3,604,584 | 9/1971 | Shank, Jr. . | |
| 3,659,394 | 5/1972 | Hartleib et al. . | |
| 3,765,991 | 10/1973 | Hoffmann . | |
| 3,834,963 | 9/1974 | Hoffman . | |
| 3,878,960 | 4/1975 | Jonsson et al. . | |
| 4,108,709 | 8/1978 | Hoffmann . | |
| 4,108,710 | 8/1978 | Hoffmann . | |
| 4,108,711 | 8/1978 | Hoffmann . | |
| 4,124,433 | 11/1978 | Herdzina et al. . | |
| 4,207,832 | 6/1980 | Bowman et al. . | |
| 4,208,236 | 6/1980 | Santefort . | |
| 4,216,044 | 8/1980 | Herdzina et al. . | |
| 4,242,167 | 12/1980 | Hoffmann . | |
| 4,323,416 | 4/1982 | Malthouse et al. . | |
| 4,336,095 | 6/1982 | Hoffmann | 156/447 X |
| 4,347,095 | 8/1982 | Yamashita . | |
| 4,366,016 | 12/1982 | Golden, Jr. . | |
| 4,406,721 | 9/1983 | Hoffmann . | |
| 4,416,714 | 11/1983 | Hoffmann . | |
| 4,425,866 | 1/1984 | Hoffmann . | |
| 4,443,285 | 4/1984 | Roth et al. . | |
| 4,447,280 | 5/1984 | Malthouse . | |
| 4,496,409 | 1/1985 | Kontz . | |
| 4,500,386 | 2/1985 | Hoffman . | |
| 4,519,868 | 5/1985 | Hoffmann . | |
| 4,526,645 | 7/1985 | Malthouse et al. . | |
| 4,544,431 | 10/1985 | King . | |
| 4,545,832 | 10/1985 | Hoffmann . | |

(List continued on next page.)

FOREIGN PATENT DOCUMENTS

| | | |
|---|---|---|
| 1012906 | 6/1977 | Canada . |
| 0144198A3 | 6/1985 | European Pat. Off. . |
| 0219267A2 | 4/1987 | European Pat. Off. . |
| 2427987 | 6/1978 | France . |
| 1106653 | 3/1968 | United Kingdom . |
| 2029280 | 3/1980 | United Kingdom . |

*Primary Examiner*—James Engel
*Attorney, Agent, or Firm*—Morgan & Finnegan

[57] ABSTRACT

A method and apparatus for applying a label onto a substantially cylindrical article is disclosed. A thin layer, heat activated adhesive hacked label is fed onto the surface of a rotating label transport drum so that the adhesive back faces outward from the drum. The adhesive is heated as the drum rotates so that the adhesive obtains a sufficient temperature to melt. Articles are conveyed into tangential spinning engagement with the drum and into rotative engagement with the leading edge of the label as the label moves into the article wrapping position so that the label wraps about the article and adheres thereto. The articles can include crayons which are somewhat tapered along their length. The articles are conveyed at a skewed angle so that the label wraps about the tapered crayon with end-to-end label alignment thereof. The crayon is conveyed onto the drum surface so that the wider "butt" end of the crayon engages the leading edge of the label before the more narrow end of the crayon engages the

26 Claims, 6 Drawing Sheets

U.S. PATENT DOCUMENTS 4,552,608 11/1985 Hoffmann et al. .
4,561,928 12/1985 Malthouse .
4,574,020 3/1986 Fosnaught .
4,604,154 8/1986 Fosnaught .
4,629,528 12/1986 Tanaka et al. .
4,632,721 12/1986 Hoffmann et al. .
4,662,925 5/1987 Thimons et al. .
4,671,836 6/1987 Fumei .
4,686,931 8/1987 Difrank .
4,693,210 9/1987 Difrank .
4,694,633 9/1987 Fujio et al. .
4,704,173 11/1987 Hoffman .
4,724,037 2/1988 Olsen .
4,726,872 2/1988 Olsen .
4,729,811 3/1988 Difrank .
4,735,668 4/1988 Hoffmann .
4,761,200 8/1988 Szeremeta .
4,772,354 9/1988 Olsen et al. .
4,781,785 11/1988 Szeremeta .
4,832,774 5/1989 Difrank et al. .
4,844,760 7/1989 Dickey .
4,844,957 7/1989 Hoffman .
4,923,557 5/1990 Dickey ..... 156/448 X
4,931,122 6/1990 Mitchell .
4,977,002 12/1990 Hoffman .
4,984,413 1/1991 Cosmo .
5,037,499 8/1991 Bright et al. ..... 156/456
5,045,140 9/1991 Dickey .
5,078,826 1/1992 Rogall .
5,091,040 2/1992 Otruba .
5,091,239 2/1992 Przeworski et al. .
5,116,452 5/1992 Eder .

PRESSURE
VACUUM
"L"
"S"
10
18
22
23
24
26
28
30
32
34
38
40
44
48
52
72
74
112
114
120
122
124
124a
124b
126
126b
128
130
132
156
158
A
1A

METHOD AND APPARATUS FOR APPLYING LABELS TO TAPERED ARTICLES

This is a divisional of co-pending application Ser. No. 08/342,780 filed Nov. 21, 1994.

FIELD OF THE INVENTION

This invention relates to a method and apparatus for applying a label to a cylindrical article such as a crayon with a heat activated adhesive backed label.

BACKGROUND OF THE INVENTION

Many millions of crayons and other similar articles are sold throughout the world by different vendors in competition with each other. Increases in the number of articles which are to be produced per minute, reduction in costs, and increased efficiency are necessary and desirable in this competitive global market.

Crayons are typically made from a soft material such as parafin wax, which is impermeable to moisture but sometimes difficult to wrap with a label because the crayon's surface is slick, making adhesive adherence difficult. Also, crayons and other similar articles are sometimes tapered about 0.005 to 0,010 inches over their two to four inch length. This taper makes application of a label to the crayon even more difficult because the label ends often will not align together due to the taper.

In one prior art method, a precut label having an inexpensive flour based adhesive on one side thereof is placed over a slot. The crayon is laid on the label and pushed into the slot. The label is bent around the crayon and then the crayon is rolled at least about one revolution to wrap the label about the crayon. The crayon and moist adhesive must then be allowed to dry. Typically, the machines used for labelling these crayons in accordance with this prior art method produce about 180 crayons a minute.

Because of increased competition and the concomitant necessity to increase production and reduce costs, it is desirable to increase labeling speeds of crayons and other similar articles to at least about 500 to 600 pieces per minute. Glue-solvent technology offers some possibilities for increasing labelling speeds. However, this technology is not as desirable because the solvents used in such large production runs are environmentally undesirable and may not work with wax-like crayons and other similar articles where a large adhesive label surface is required.

SUMMARY OF THE INVENTION

It is therefore an object of the present invention to apply a label to a substantially cylindrical article such as a crayon by an improved and more efficient means.

It is another object of the present invention to increase the number of labelled crayons per minute while maintaining high quality labelling thereof.

In accordance with the present invention, an apparatus applies a label to a substantially cylindrical article such as a crayon and has a label transport drum which is rotated by a main drive mechanism. A label feed mechanism includes a cutting drum and feeds a thin layer, heat activated adhesive backed strip of label material onto the surface of the cutting drum, which cuts the strip into label segments and feeds them onto the label transport drum so that the adhesive back faces outward from the drum. The adhesive is heated as the label transport drum rotates so that the adhesive obtains a sufficient temperature to melt.

Substantially cylindrical articles such as tapered crayons are conveyed into tangential spinning engagement with the drum and into rotative engagement with the leading edge of the label as the label moves into an article wrapping position so that the label wraps about the crayon and adheres thereto. In one aspect of the invention, the cylindrical articles, i.e. crayons, are about two to four inches long and tapered along their length by about 0.005 to 0.010 inches.

The articles are conveyed into tangential spinning engagement with the drum and into engagement with the leading edge of a label at a skewed angle so that the label wraps about the tapered article with end-to-end alignment thereof. As the article is conveyed onto the drum, the wider "butt" end of the article engages the leading edge of the label before the more narrow end. A star wheel transfer assembly can be used to convey the articles onto the drum surface. The articles are held in article holding notches of the starwheel in a skewed configuration.

The label transport drum in one aspect of the present invention includes orifices located at an area of the drum surface where a label is positioned. Vacuum is drawn through the orifices for retaining the label on the drum surface as the drum rotates. Air is then blown through the orifices underlying the leading edge of the label to blow the leading edge of the label onto the article at the article wrapping position.

A heat source initially heats the adhesive and ensures that the hot melt adhesive has obtained a sufficient temperature to melt so that it adheres to the cylindrical article and to the label overlap when wrapped. The articles can be a wide variety of different articles such as a wax crayon. When crayons are used, the hot melt adhesive layer positioned on the label is about 0.0005–0.001 inches thick. It has been found that a low temperature hot melt adhesive having a melting range of about 140 to about 170 degrees Fahrenheit is sufficient for use with the invention. Typical adhesives could include Findley Adhesives Inc. 300-634 and H. B. Fuller Company HM-0727 hot melt adhesives.

In another aspect of the invention, pressure is imparted onto the article as it is wrapped. A pressure plate is positioned adjacent the article wrapping position and it is biased into engagement with the article. The camber of the pressure plate is varied relative to any articles conveyed on the surface of the drums so as to impart a side-by-side differential pressure against an article during labelling to ensure end-to-end label alignment over the article. Also, the pressure plate is adjustable for varying the wrapping pressure of the label on the article.

A preferred crayon formed by this process of the present invention includes a cylindrical crayon body that is tapered along its length having a butt end with a diameter that is at least about 0.005 inches larger than its opposing end. The hot melt adhesive backed label is wrapped circumferentially about the crayon body. The label has leading and trailing edges and the leading edge is applied onto the crayon body at a skewed angle relative to the longitudinal axis of the body so that the label is wrapped circumferentially about the crayon body with end-to-end label alignment. The adhesive adheres the label to the crayon body and to the label overlap. Rotation under the pressure pad after wrapping of the label cools the adhesive.

DESCRIPTION OF THE DRAWINGS

These and other objects and advantages of the present invention will be appreciated more fully from the following description, with references to the accompanying drawings in which.

DETAILED DESCRIPTION OF THE INVENTION

Figures 1, 1A:
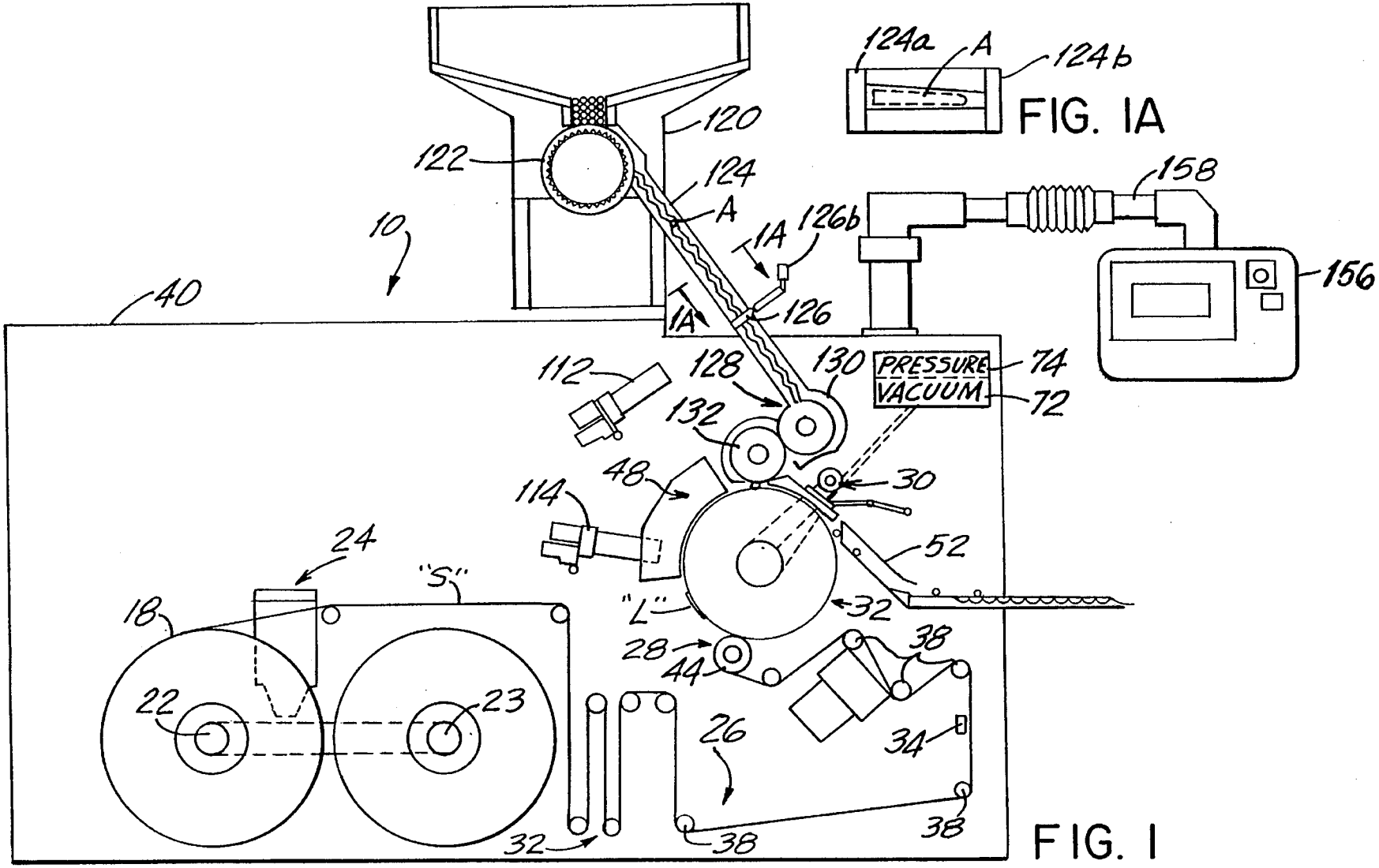
FIG. 1 is a schematic, elevation view of the overall apparatus which applies labels onto cylindrical articles such as crayons in accordance with the present invention.
FIG. 1A is a schematic sectional view taken along line 1A—1A of FIG. 1, showing the tapered track.
Figure 12:
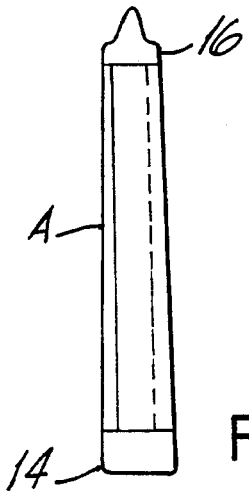
FIGS. 12 is an isometric view of a novel crayon in accordance with the present invention which has been wrapped by the method of the present invention and showing with hidden lines the initially skewed leading edge of the label.

Referring now to FIG. 1, there is illustrated at 10 a schematic, overall illustration of the apparatus for applying a label onto a substantially cylindrical article such as tapered crayon wherein the label has seams aligned end-to-end on the article (FIG. 12).

The labels are thin layer, heat activated adhesive backed labels typically having at least one layer of paper with the adhesive applied evenly on one side. Throughout this description, the labels will be referred to by the letter "L." The apparatus 10 may be used for applying a label to different tapered and nontapered articles and crayons requiring good end-to-end alignment of the label ends and high production speeds, which the apparatus and method of the present invention can provide.

The apparatus 10 is suitable for high quality cylindrical labelling of different articles requiring the application of thin labels having a thickness typically less than about 0.005 inches. Throughout the description and drawings, the cylindrical articles on which the labels are applied will be referred to as crayons and will be illustrated as such and given the reference letter "A." The illustrated crayons are typically formed from parafin wax, and have a surface which is smooth and slick, making it resistant to water and some adhesives. In one desired application, the crayons are tapered, having one end about 0.322 inches diameter and the other end about 0.314 inches diameter, giving a taper of 0.007 inches from the wide "butt" end 14 of the crayon to the more narrow end 16. (FIG. 12) The crayons typically are about two to four inches long.

In one aspect of the invention, the label material applied to the illustrated crayons typically includes one layer of paper which is coated completely on one side with the heat activated adhesive. The paper can be a course grain paper which is inexpensive, but economical and practical considering the numerous crayons which are labelled. In accordance with the present invention, the heat activated adhesive layer is applied at about a one half to one mil coating thickness i.e., 0.0005–0.001 inches. The adhesive is a low temperature heat activated adhesive which melts at a temperature range of about 140° to 170° F. Typical examples include a hot melt adhesive sold by Findley Adhesives, Inc.

In accordance with the present invention, the label materials are initially supplied as a roll 18 of strip label material "S" which can be positioned on a mandrel 22 of a feeder assembly indicated generally at 24. In the illustration, a double mandrel 22, 23 each holds a roll 18. As one roll 18 is used, the other roll 18 or mandrel 23 then is fed which maintains production. The strip "S" of label material is then fed through a feedroll assembly, indicated generally at 26, and to a cutting drum assembly, indicated generally at 28, which is operatively connected to the main drive motor and transmission assembly 30 of a label transport drum indicated generally at 32. A registration and sensing system 34 sense label indicia to ensure proper cutting on the strip and ensure quality cutting of the labels. The registration can include a FIFE label edge registration control sensing system for printed label registration marker. The feedroll assembly 26 includes a dancer roll assembly 36 and feedrolls 38 which move the strip S into the cutting drum assembly 28.

The label transport drum 32 typically is supported on a frame assembly 40. The main drive motor and transmission assembly 30 is supported by the frame 40 and rotates the label transport drum 32 as well as the cutting drum assembly by a suitable transmission 28. The cutting drum assembly 28 includes a cutting roll 44 which is mounted to the machine frame 40 and positioned adjacent the label transport drum 32 at a lower portion thereof as shown in FIG. 1. The cutting roll 44 cuts the label strips into segments, i.e., labels, which are then fed onto consecutive label receiving positions, indicated at 46, of the label transport drum 32. (FIGS. 2, 3, and 5) Each label moves with the rotating drum 32 into a heat tunnel, indicated at 48, where the adhesive is melted, and then into an article wrapping position, indicated at 50, where crayons are fed into tangential spinning engagement with the drum surface and into rotative engagement with a leading edge of the label "L" as the label moves into the article wrapping position so that the label wraps about the crayon and adheres thereto by means of the melted adhesive. The wrapped crayons are then discharged into a discharge chute 52.

Figure 8:
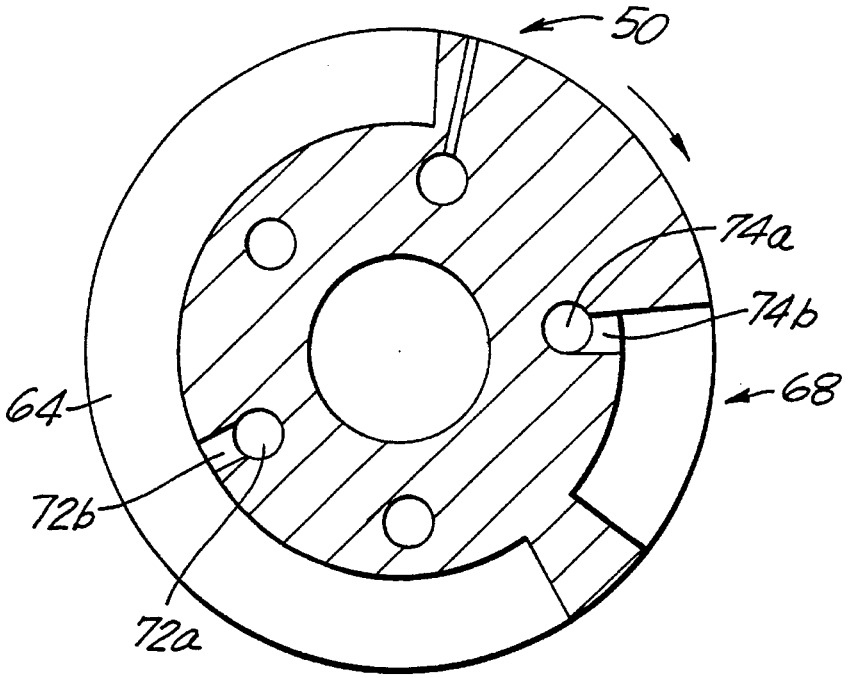
FIG. 8 is a sectional view of the hub showing the first vacuum and pressure manifolds and blow off manifold.
Figure 9:
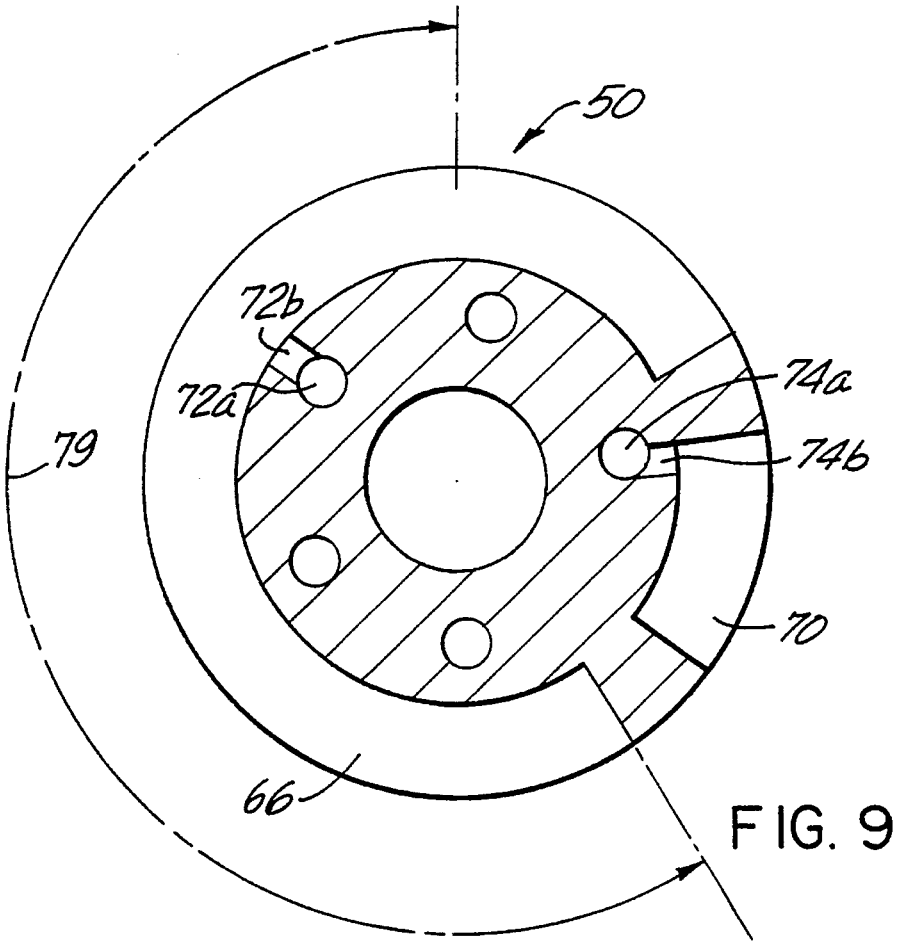
FIG. 9 is a sectional view of the hub showing the second vacuum manifold and blow off manifold.

Referring now to FIGS. 5–9, details of one embodiment of the label transport drum 32 which can be used for the present invention is shown. As illustrated, a label drum, indicated at 60, is rotatably received over a central hub 62. As shown in FIGS. 8 and 9, respective first and second radially extending, slotted vacuum manifolds 64, 66 and blow-off manifolds 68, 70 are formed on the outer surface of the hub 62. The vacuum and blow-off manifold at 64, 68 of FIG. 8 are aligned circumferentially with each other, as are the manifolds 65, 70 of FIG. 9 with each other. Respective sources of vacuum and pressure (shown schematically at 72, 74, FIG. 1) operatively connect to horizontal vacuum manifolds 72*a*, and gate manifolds 72*b*, and horizontal pressure manifolds 74*a*, and gate manifold 74*b*. An air pressure manifold 76 provides air against a leading edge of a label. As will be explained later, the second vacuum manifold extends a further arc distance 79 than the first vacuum manifold 64. The second vacuum manifold 66 retains the label on the drum surface if a label is not transferred onto an article. Once the drum 60 continues its rotation, the blow-off manifolds 68, 70 exert pressure on the label to blow it from the drum surface. Further details of a hub and drum label construction which can be used in the present invention are set forth in U.S. Pat. No. 5,344,519, issued Sep. 6, 1994, the disclosure which is hereby incorporated by reference.

Figure 5:
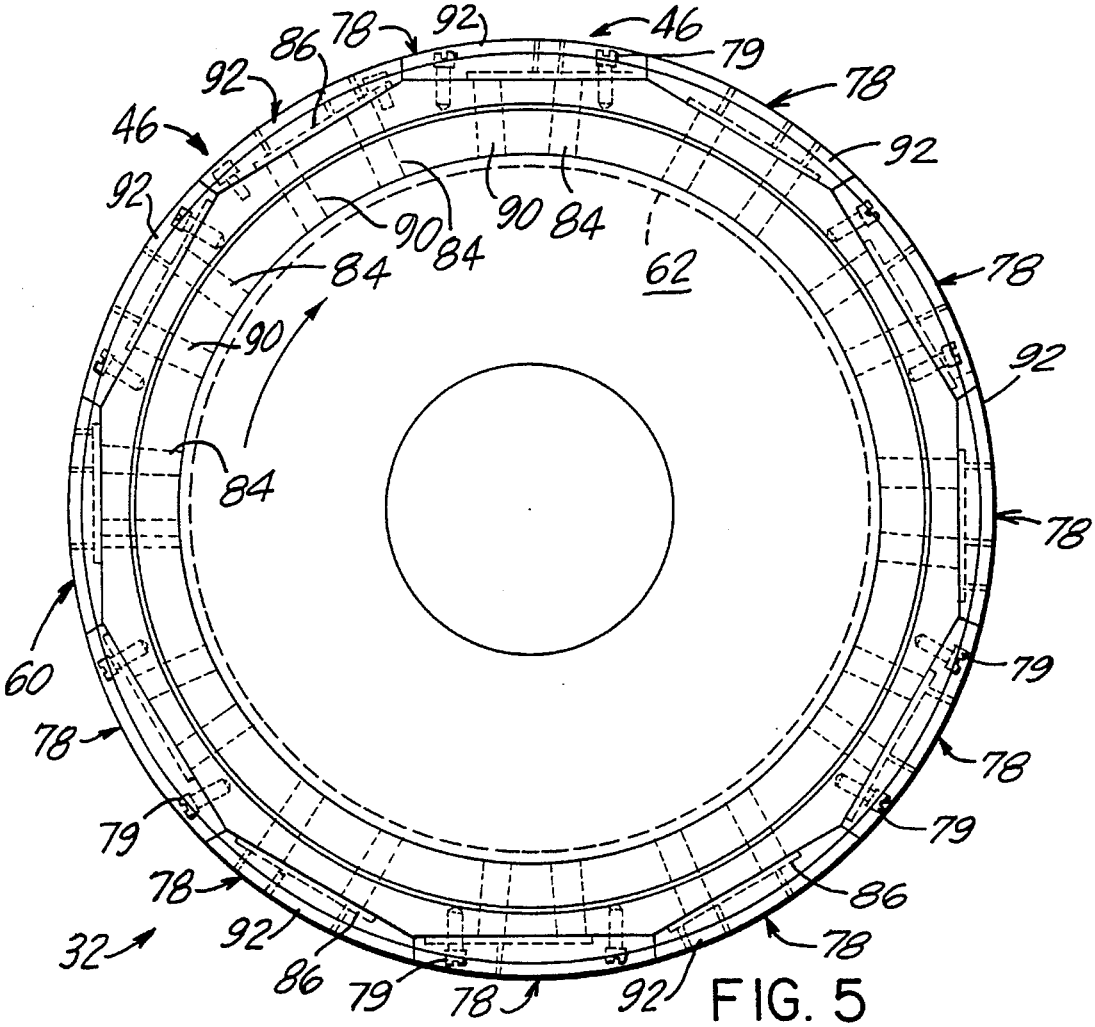
FIG. 5 is a partial sectional view of the label transport drum showing twelve evenly spaced label retaining insert plates positioned on the outer surface of the drum.
Figure 7:
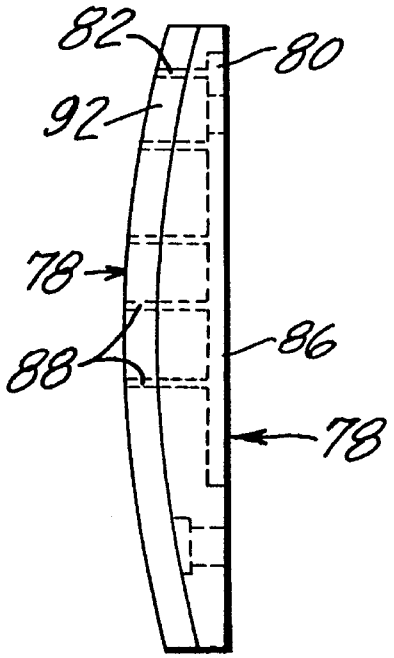
FIG. 7 is a side elevation view of a label retaining insert plate.
Figure 6:
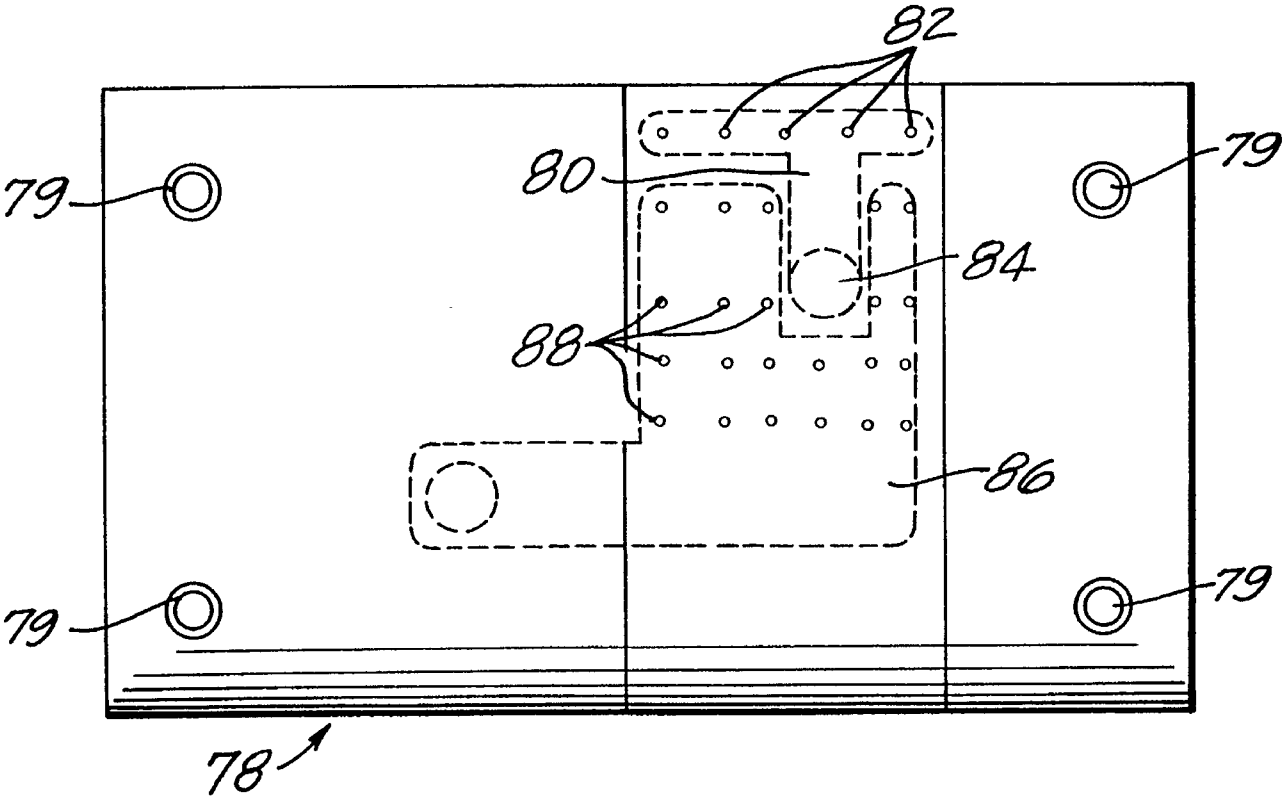
FIG. 6 is a top view of a label retaining insert plate.

Twelve evenly spaced label retaining insert plates, indicated at 78, are positioned on the surface of the label drum 60 (FIG. 5). Each insert plate 78 is rectangularly configured (FIG. 6), and has a top surface that is configured substantially similar to the curvature of the drum surface. Screws 79 can secure the plates 78 to the drum 60 and be used on every plate 78 or every other plate, with every other unscrewed plate held by contiguous screwed plates. The under surface of each insert plate includes two plenums formed in the surface as shown in FIG. 6. A first plenum 80 is formed on the undersurface and has orifices 82 extending upward which communicate with a surface of the insert plate at that area where the leading edge of a label is to be positioned. The first plenum communicates with a port 84 in the drum 60 which is positioned in circumferential alignment with the first vacuum manifold 64 and pressure manifold 76.

A second plenum 86 is formed in the undersurface and has orifices 88 extending upward therethrough to communicate with the surface of the insert plate at an area where the trailing edge and midportion of the label are positioned. The second plenum 86 extends to a port 90 of the drum which is aligned circumferentially with the second vacuum manifold.

Figure 2:
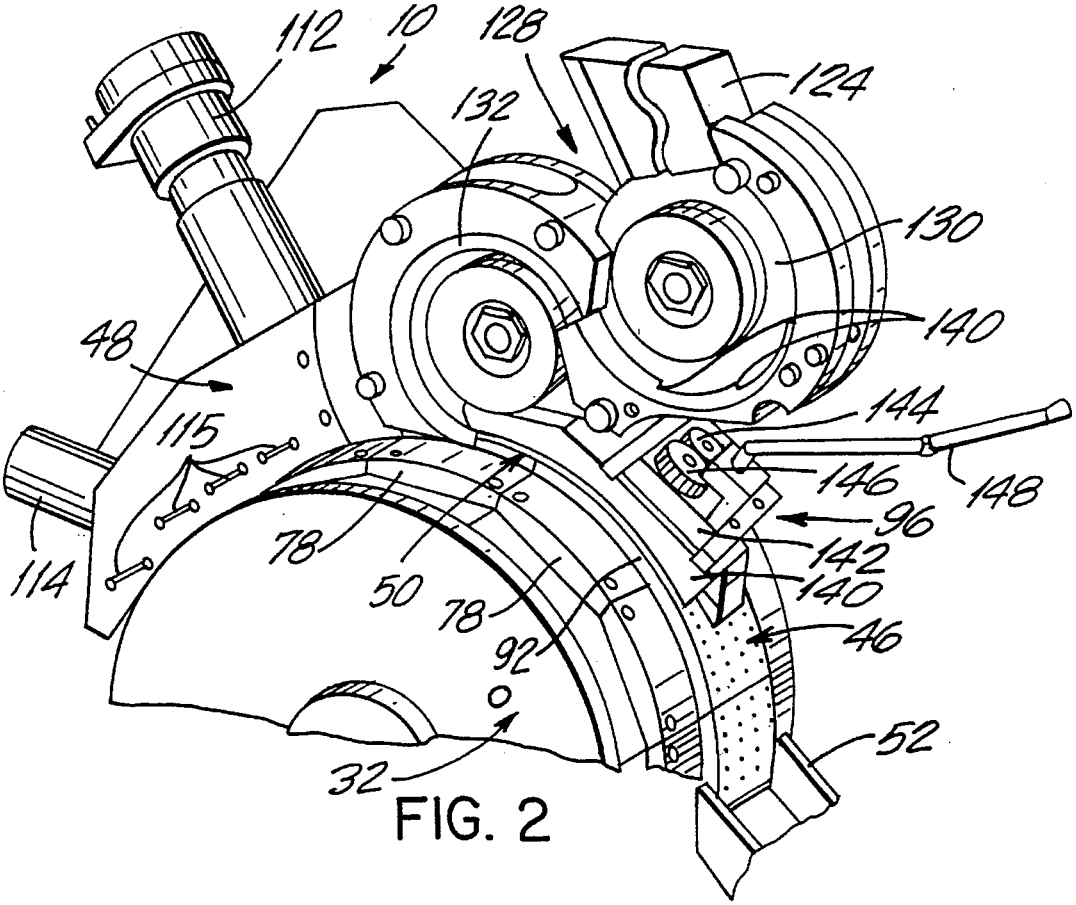
FIG. 2 is a schematic, isometric view of the label transport drum showing the star wheel assembly, heater assembly and pressure pad assembly.
Figure 3:
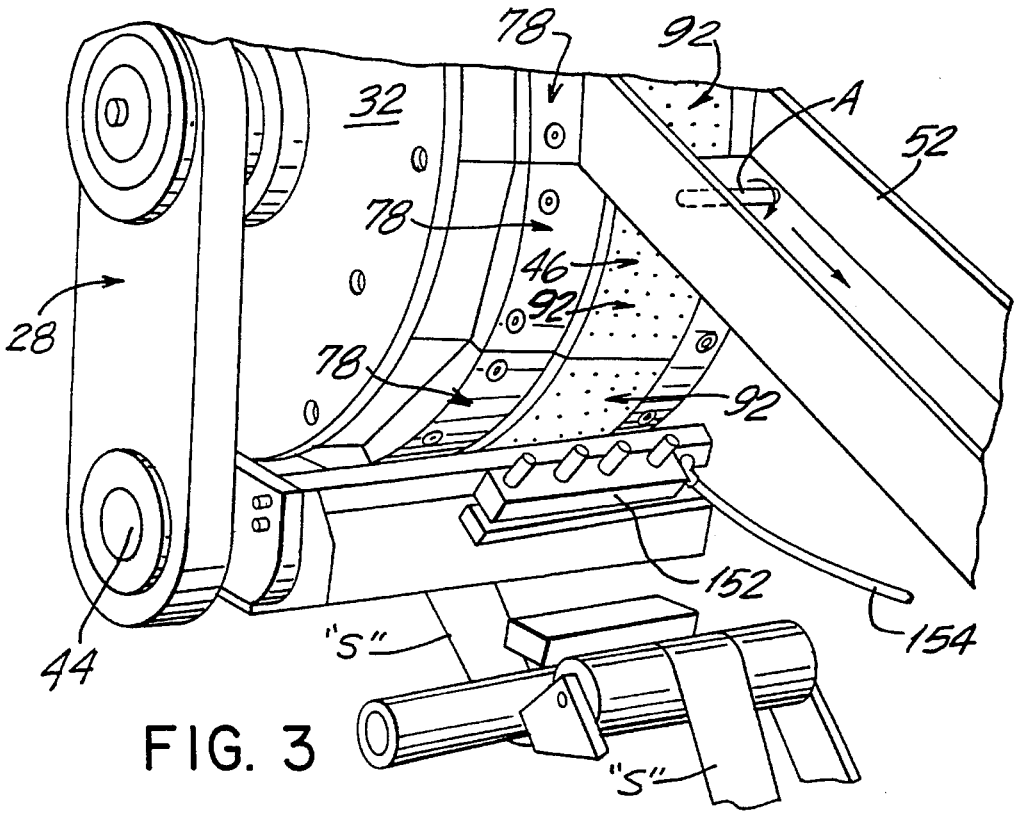
FIG. 3 is a schematic, isometric view of a lower portion of the label transport drum showing the jet air nozzles, cutter assembly and discharge chute.

Each insert plate has a resilient pad 92 (FIGS. 2, 3, 5, and 7) placed over a substantial portion of the outer surface of the insert plate. The orifices 82, 88 are formed within the resilient pad. The resilient pads 92 can be formed preferably from silicon or other similar material. The pads 92 are contiguous with each other (FIGS. 3 and 5) and form a soft cushion on which the crayon rolls during wrapping and also forms a smooth surface on which the label lies as the label moves from its initial position after cutting when it is first fed onto the drum surface and then moves into the article wrapping position 50 (FIG. 2). Because the silicon pads 92 act somewhat as a cushion, the crayon is deflected slightly into the cushion material by means of a pressure applicator, indicated at 96, so as to create a "footprint" in the soft cushion material. During crayon wrapping, the air is squeezed out between the crayon, label and pad surface, allowing better wrapping of the label about the crayon. Additionally, the silicon pads 92 have greater friction between the crayons in the drum surfaces compared to steel or an aluminum surface so that less pressure need be applied by the pressure applicator.

The label retaining insert plates 78 are limited in the illustrated embodiment to about a four and one-half inch long label corresponding to about four and a half inch wide insert plate. This has been found adequate for labelling most conventional crayons and other similar articles.

If longer labels are to be used for larger diameter articles, the insert plates 78 can be made deeper and fewer in number, and thus longer along the arcuate portion of the top surface since the plate is longer and has a longer surface length on which the arc extends. However, the length is still limited because too deep an insert plate 78 would interfere with the drum rotation about the hub. A larger label drum 60 and hub 62 would have to be constructed. Further details of one example of the plate construction which could be used for the present invention can be found in the incorporated by reference '519 patent.

Once the label is received into the label receiving position 46 on the label transport drum 32, vacuum holds the label onto the drum surface. The label transport drum rotates and moves the label into the heat tunnel 48 where the adhesive is heated to its melting point. At high operating speeds of about 500 to 600 articles per minutes, the heat time is about 0.25 seconds.

Figure 4:
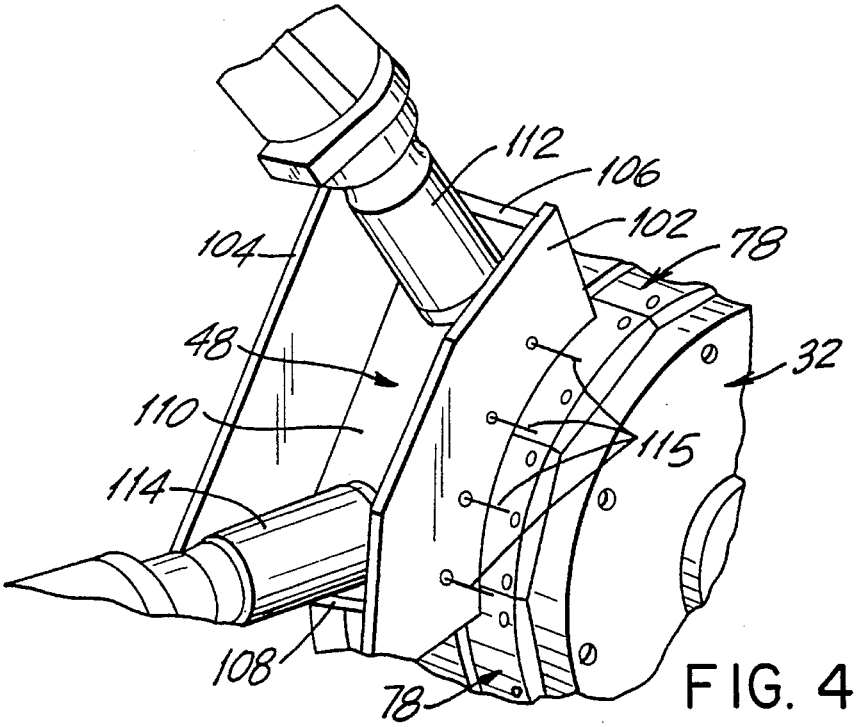
FIG. 4 is a schematic, isometric view of the label transport drum showing the heater assembly.

As shown in FIG. 4, the heating tunnel 48 is defined by two opposing side bracket plates 102, 104, a front and rear end plate 106, 108 and a top cover plate 110, and forms a heat tunnel positioned closely adjacent the surface of the label transport drum in a position before the article wrapping position as shown in FIG. 2. Two high powered ceramic heater and blower assemblies 112, 114 are mounted on the top plate 110 at the front and rear portions. Both heaters produce a 1,000° F. blast of hot air. The first rear heater 114 amplifies and heats the heat activated adhesive, and the second front heater 112 amplifies that heat to ensure that the hot melt adhesive melts adequately. The total time in which the label is contained within the heat tunnel is about 0.25 seconds, and corresponds to the high operating speeds of about 500 to 600 crayons per minute. Temperature sensors 115, preferably thermocouples, sense temperature in the heating tunnel 48. The heater and blower assemblies 112, 114 then are adjusted accordingly. The system can be temperature controlled through a closed loop controller.

The labels then continue into the article wrapping position 50 where they engage the crayons which had been fed from a hopper 120 positioned at the top portion of the frame 40 (FIG. 1). The crayons are retained in the hopper 120 and a large gear 122 positioned at the lower discharge end of the hopper grabs a crayon at the eleven o'clock position and rotates it approximately ninety degrees to release it into a serpentine guide 124. The crayons continue downward through the serpentine guide 124, through a gate 126, and into a double star wheel assembly indicated generally at 128. The gate 126 between the serpentine transfer and first starwheel transfer roll is formed of latex rubber and soft enough so that it does not break the crayon it engages. The gate 126 is normally biased in the closed position to prevent crayons from moving from the serpentine into the first starwheel transfer roll. A cylinder 126*a* actuates a piston 126*b* which raises the gate 126 to allow transfer of crayons from the serpentine 124 into the article receiving positions of the first starwheel. The serpentine transfer 124 has an inner and outer rail 124*a*, 124*b*. The spacing between the inner rail 124*a* has a larger gap than the spacing of the outer rail 124*b* to accommodate the taper of the crayons 140 (FIG. 1A).

Figure 10:
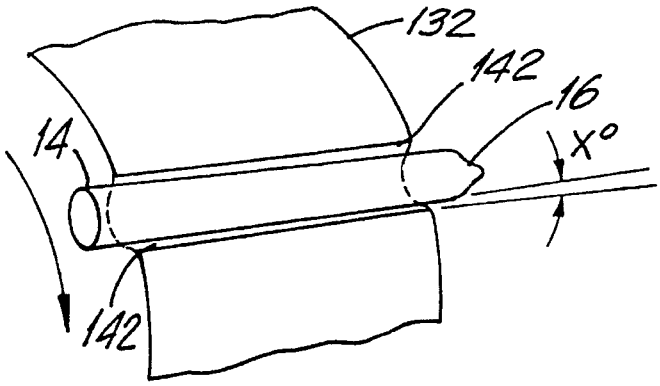
FIG. 10 is an exaggerated schematic, isometric view of a crayon positioned skewed in an article receiving slot of a star wheel.

The double starwheel assembly 128 can be driven off the main drive system or a separate drive system and only for the starwheel assembly. In the illustrated embodiment, the starwheel assembly includes two starwheels. Article receiving slots 140 of the first star wheel 130 receive the crayons and transfer them into the second star wheel 132. The second star wheel has its article receiving slots 142 formed such that the article, i.e., crayon, is slightly skewed about 0.5 degrees (angle X°) within the slots (FIG. 10). This skewing can be accomplished by forming the slots 142 so that the crayon lies skewed therein, or by using inserts (not shown) which skew the crayon when positioned within the slot 142. As the second starwheel 132 rotates, the crayon moves downward into tangential spinning engagement with the drum surface and into engagement with the leading edge of a label at a skewed angle.

Figure 11:
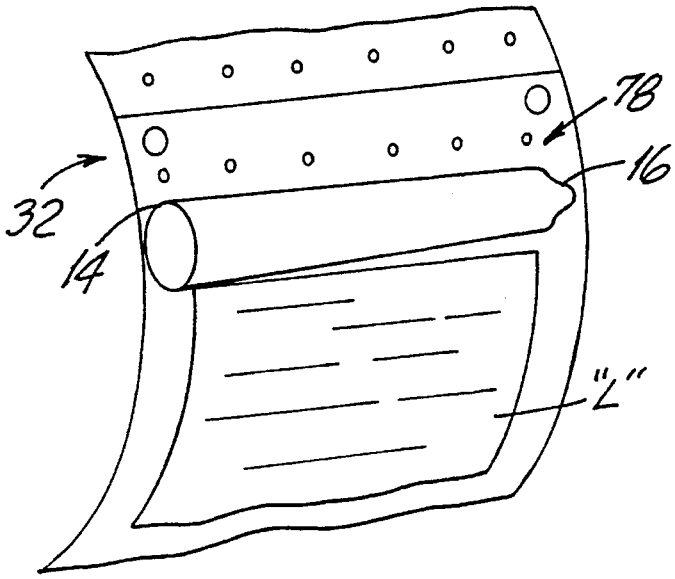
FIG. 11 is an exaggerated schematic, isometric showing the leading edge of a label engaging the butt end of the crayon during label wrapping.

As shown in FIG. 11, the crayons are conveyed onto the drum surface so that the wider "butt" end 14 of a crayon first engages the leading edge of a label before the opposing end. This effectively compensates for the taper of the crayon. At the same time, the leading edge ports 84 in the drum are aligned with each insert plate move over the pressure manifold 76. The jet of the leading edge of the label air from the manifold forces outward into engagement with the crayon.

During labeling, the pressure applicator 96 imparts pressure to the crayon as it is wrapped. The pressure applicator 96 includes a pressure plate 140 (FIG. 2) that has a bottom surface engaging the crayon. The pressure plate 140 is spring biased and supported by a second support plate 142 fixed to the frame. Two respective pinion gears 144, 146 are positioned on the support plate 142 and mesh with each other. The pinion gears 144, 146 have threaded central shafts which engage the spaced pressure plate 140. A third gear (not shown) engages both pinion gears 144, 146, and is rotatable by a handle-shaft 148. As the handle-shaft 148 is turned, the third gear turns both gears so that they rotate in opposite directions, thus biasing the pressure plate against the side of the crayon. The amount of biasing force against the ends of the crayon determines how much the label can be aligned. The pressure plate 140 can also be adjusted closer or farther from the label transport drum, which varies the pressure of wrapping the label on the article. Also, the crayon, once wrapped, is rolled further under pressure from the pressure plate which further cools the adhesive.

The label then wraps around the crayon and the adhesive cooled as it rolls and then moves into the discharge chute 52 where it is then transferred into an article conveyor 150. Because the label engaged the "butt" end of the crayon first during wrapping, the taper is compensated for with the result that the label ends are aligned (FIG. 12). Without skewing the article slightly, the label ends would not be aligned.

The resilient pads 78 can become very hot during high speed operation, especially materials like silicon, and therefore a bank of airjets 152 are positioned after the discharge chute 52 These jets blow high speed air onto the silicon pads to cool same. A compressed air source and lines 154 provide the necessary air flow. A controller 156 is mounted as a movable swing arm 158 and controls machine operation. It can be easily swung out of the way.

In operation, a strip S is initially fed from a feed roll 18 into the feed roll assembly 26 and cutter drum assembly 28. The registration and sensor unit maintains proper registration of any label indicia with the cutting drum so that labels are properly cut at proper indicia and transferred exactly onto the label retaining positions 46 of the label transport drum 42. The drum rotates and moves labels through the heating tunnel 48, and then into the article wrapping position 50 where the leading edge of the label is forced upward into engagement with the skewed crayon, which has been fed from the second transfer roll. During wrapping, because the butt end of the crayon engages the leading edge of the label first, the label is wrapped and has end-to-end alignment of labels. The label then moves to a point where it is discharged into the chute and then transferred onto the conveyor.

It should be understood that the foregoing description of the invention is intended merely to be a illustrative thereof, and that other embodiments, modifications and equivalents may be apparent to those skilled in the art without departing from its spirit.

That which is claimed is:

1. A method for applying a label onto a longitudinally extending cylindrical article that is somewhat tapered along its length and has a wider "butt" end and more narrow opposing end comprising the steps of feeding a substantially rectangular configured, thin layer, heat activated adhesive backed label onto the surface of a label transport drum, heating the adhesive as the drum rotates so that the adhesive obtains a sufficient temperature to melt, and presenting the article at a skewed angle relative to the label transport drum surface, while also conveying the tapered articles into tangential spinning engagement with the drum and into engagement with the leading edge of a label at a skewed angle where the wider "butt" end of the article engages the leading edge of the label before the opposing narrow end so that the label wraps about the tapered article with end-to-end alignment thereof.

2. A method according to claim 1 including conveying the articles onto the drum from a star wheel transfer assembly, wherein the articles are contained in article holding notches of the star wheels in a skewed configuration.

3. A method according to claim 1 including the step of drawing a vacuum through orifices retained on the label transport drum for retaining the label on the drum surface as the drum rotates, and then blowing the leading edge of the label onto the article.

4. A method according to claim 1 including the step of moving the label past a first heat source to initially heat the adhesive, and then moving the label past a second heat source for ensuring that the hot melt adhesive has obtained a sufficient temperature to melt so that it adheres to the cylindrical article.

5. A method according to claim 1 wherein the articles are crayons and the heat activated adhesive layer positioned on the back of the paper is about 0.0005–0.001 inches thick.

6. A method according to claim 5 wherein the heat activated adhesive has a melting range of about 140 to about 170 degrees Fahrenheit, and including the step of heating the hot melt adhesive for about 0.25 seconds.

7. A method according to claim 1 including the step of imparting pressure to the article as it is wrapped.

8. A method according to claim 7 including biasing a pressure plate into engagement with the article and varying the camber of the pressure plate relative to articles conveyed on the surface of the drum so as to impart a side-to-side differential pressure against the articles so as to obtain end-to-end label alignment.

9. An apparatus for applying a label onto a longitudinally extending cylindrical article that is somewhat tapered along its length and has a wider "butt" end and more narrow opposing end comprising a label transport drum, means for rotating the label transport drum, means for feeding a substantially rectangular configured, thin layer, heat activated adhesive backed label onto the surface of said label transport drum, means for heating the adhesive as the drum rotates so that the adhesive obtains a sufficient temperature to melt, and means for presenting the articles at a skewed angle relative to the label transport drum surface and conveying the tapered articles into tangential spinning engagement with the drum and into engagement with the leading edge of a label at a skewed angle where the wider "butt" end of the article engages the leading edge of the label before the opposing narrow end so that the label wraps about the tapered article with end-to-end alignment thereof.

10. An apparatus according to claim 9 wherein said means for conveying the articles onto the drum comprise a star wheel transfer assembly, wherein the articles are contained in article holding notches of the star wheels in a skewed configuration.

11. An apparatus according to claim 9 wherein said label transport drum includes orifices located at an area of said drum surface where a label is positioned, and including means for drawing a vacuum through said orifices for retaining the label on the drum surface as the drum rotates, and means for blowing air through said orifices underlying said leading edge of the label to blow the leading edge onto the article at the article wrapping position.

12. An apparatus according to claim 9 including a first heat source to initially heat the adhesive, and a second heat source for ensuring that the heat activated adhesive has obtained a sufficient temperature to melt so that it adheres to the cylindrical article.

13. An apparatus according to claim 9 including means for imparting pressure to the article as it is wrapped.

14. An apparatus according to claim 9 including means for biasing a pressure plate into engagement with the article and means for varying the camber of the pressure plate relative to articles conveyed on the surface of the drum so as to impart a side-to-side differential pressure against the articles and end-to-end label alignment.

15. An apparatus according to claim 9 wherein the articles are crayons and the heat activated adhesive layer positioned on the back of the paper is about 0.0005–0.001 inches thick.

16. An apparatus according to claim 9 wherein the heat activated adhesive on said label has a melting range of about 140 to about 170 degrees Fahrenheit.

17. A method for applying a label onto a longitudinally extending cylindrical article that is tapered along its length and has a wider "butt" end and more narrow opposing end comprising the steps of:

feeding a substantially rectangular configured, thin layer label onto the surface of a label transport drum; and presenting the articles at a skewed angle relative to the label transport drum surface, while also conveying the tapered articles into tangential spinning engagement with the drum and into engagement with the leading edge of the label at a skewed angle where the wider "butt" end of the article engages the leading edge of the label before the opposing narrow end so that the label wraps about the tapered article with end-to-end alignment thereof.

18. A method according to claim 17 including conveying the articles onto the drum from a starwheel transfer assembly, wherein the articles are contained in article holding notches of the starwheel in a skewed configuration.

19. A method according to claim 17 including the step of drawing a vacuum through orifices retained on the label transport drum for retaining the label on the drum surface as the drum rotates, and then blowing the leading edge of a label onto the article.

20. A method according to claim 17 including the step of imparting pressure to the article as it is wrapped.

21. A method according to claim 20 including biasing a pressure plate into engagement with the article and varying the camber of the pressure plate relative to tapered articles conveyed on the surface of the drum so as to impart a side-to-side differential pressure against the articles and obtain end-to-end label alignment.

22. An apparatus for applying a label onto a longitudinally extending cylindrical article that is tapered along its length and has a wider "butt" end and more narrow opposing end comprising:

a label transport drum, means for rotating the label transport drum, means for feeding a substantially rectangular configured, thin layer label onto the surface of said label transport drum, and means for presenting the articles at a skewed angle relative to the label transport drum, and conveying the tapered articles into tangential spinning engagement with the drum and into engagement with the leading edge of a label at a skewed angle where the wider "butt" end of the article engages the leading edge of the label before the opposing narrow end so that the label wraps about the tapered article with end-to-end alignment thereof.

23. An apparatus according to claim 22 wherein the means for conveying the article onto the drum comprises a starwheel transfer assembly, wherein the articles are contained in article holding notches of the starwheel in a skewed configuration.

24. An apparatus according to claim 22 wherein said label transport drum includes orifices located an area of said drum surface where a label is positioned, and including means for drawing a vacuum through said orifices for retaining the label on the drum surface as the drum rotates, and including means for blowing air through said orifices underlying said leading edge of a label to blow the leading edge onto the article at the article wrapping position.

25. An apparatus according to claim 22 including means for imparting pressure to the tapered article as it is wrapped.

26. An apparatus according to claim 25 including means for biasing a pressure plate into engagement with the tapered article and means for varying the camber of the pressure plate relative to articles conveyed on the surface of the drum so as to impart a side-to-side differential pressure against the articles and end-to-end label alignment.

* * * * *

UNITED STATES PATENT AND TRADEMARK OFFICE

CERTIFICATE OF CORRECTION

PATENT NO. : 5,522,960

DATED : June 4, 1996

INVENTOR(S) : Robert M. Rello, Micheal Yager & Ramon Antonio Martinez

It is certified that error appears in the above-indentified patent and that said Letters Patent is hereby corrected as shown below:

IN THE ABSTRACT:

line 3 of the Abstract, change "hacked" to "backed";

line 18, at the end of the Abstract, after the word "the" insert "label.";

At Column 1, line 26, change "0,010" to --0.010--;

At Column 6, line 23, change "1,000°F.blast" to --1,000°F blast--;

At Column 7, line 45, after the number "52" insert --.--;

Signed and Sealed this

Tenth Day of September, 1996

*Attest:*

*Attesting Officer*

BRUCE LEHMAN

*Commissioner of Patents and Trademarks*